US006883881B2

(12) United States Patent
Gauss

(10) Patent No.: US 6,883,881 B2
(45) Date of Patent: Apr. 26, 2005

(54) PORTABLE KITCHEN

(75) Inventor: Kurt F. Gauss, Liberty Lake, WA (US)

(73) Assignee: GSI Sports Products, Inc., Spokane, WA (US)

( * ) Notice: Subject to any disclaimer, the term of this patent is extended or adjusted under 35 U.S.C. 154(b) by 1 day.

(21) Appl. No.: 10/347,039

(22) Filed: Jan. 17, 2003

(65) Prior Publication Data

US 2004/0140740 A1 Jul. 22, 2004

(51) Int. Cl.[7] ..... A47B 83/00

(52) U.S. Cl. ..... 312/237; 312/236; 312/228; 312/229; 312/281; 108/65; 108/152

(58) Field of Search ..... 312/281, 140.2, 312/140.1, 140.3, 228, 228.1, 229, 237, 246, 280, 317.2, 317.3, 351.1, 351.3, 236; 108/132, 152; 248/166, 434, 240, 240.3, 408, 170; 4/675, 676, 677, 678, 695, 619, 625, 626, 638, 650

(56) References Cited

U.S. PATENT DOCUMENTS 1,318,229 A * 10/1919 Peters ..... 312/228
1,903,262 A * 3/1933 Goings ..... 126/332
3,068,821 A * 12/1962 Hermanns ..... 112/260
3,289,664 A * 12/1966 Hewitt ..... 126/37 R
3,502,384 A * 3/1970 Gipson ..... 312/228
3,666,339 A * 5/1972 Neufeld ..... 312/277
3,822,847 A * 7/1974 Emmons ..... 248/210
3,915,529 A * 10/1975 Bernier ..... 312/237
3,983,583 A * 10/1976 Herman et al. ..... 62/331
4,779,940 A * 10/1988 Ralston ..... 312/241
4,934,280 A * 6/1990 Bae ..... 108/99
5,349,708 A * 9/1994 Lee ..... 4/638
5,375,272 A * 12/1994 Mikol ..... 4/695
5,465,438 A * 11/1995 Allman et al. ..... 4/626
5,913,270 A * 6/1999 Price ..... 108/101
6,000,345 A * 12/1999 Gillotti ..... 108/36
6,047,750 A * 4/2000 Jensen ..... 144/286.1
6,301,728 B1 * 10/2001 Pilatowicz et al. ..... 4/695
6,427,259 B1 * 8/2002 Cawthon ..... 4/650
6,481,983 B1 * 11/2002 Miller ..... 417/411
6,484,330 B2 * 11/2002 Gray et al. ..... 4/684
6,591,434 B1 * 7/2003 De Cleene et al. ..... 4/619
6,611,972 B2 * 9/2003 Underbrink et al. ..... 4/619

OTHER PUBLICATIONS http:/www.coleman.com, "Coleman Exponent Outfitter Camp Kitchen," Printed Dec. 16, 2002, 2 pages.

* cited by examiner

*Primary Examiner*—Peter M. Cuomo
*Assistant Examiner*—Stephen D'Adamo
(74) *Attorney, Agent, or Firm*—Wells St. John P.S.

(57) ABSTRACT

A portable kitchen is described and which includes a kitchen surface having a food preparation area and first and second sink areas defined by the kitchen surface; and a heat resistant surface which can be releasably mounted in a plurality of operable orientations relative to the kitchen surface.

35 Claims, 10 Drawing Sheets

PORTABLE KITCHEN

TECHNICAL FIELD

The present invention relates to a portable kitchen, and more particularly, to a portable kitchen which may be used in remote camping and other recreational sites and which can be configured and thereafter deployed in a multiplicity of different arrangements to serve the various needs of an end user.

BACKGROUND OF THE INVENTION

A multiplicity of different camping kitchens are commercially available from various commercial vendors, and which are useful as food preparation centers for a multiplicity of outdoor activities including camping, tailgating, family gatherings, or the like.

An example of a commercially available camping kitchen of the type described is manufactured and sold by the Coleman Company and is identified as the "Exponent Deluxe Camping Kitchen." This commercially available folding camping kitchen includes among other things a kitchen surface having a removable sink with drain; a plug for the sink; a removable drain hose; a game board on a lid and which also operates to cover the kitchen surface when the kitchen is not in use; and a side table having a fire resistant or metal surface which folds outwardly from below the kitchen surface and which is generally oriented in coaxial relationship relative thereto. This camping kitchen is fabricated of heavy duty aluminum and folds to a size which usually will fit easily into most car trunks.

Other prior art camping kitchens have included various containers or enclosures which provide assorted sized storage spaces for enclosing various camping supplies such as gas stoves, cooking utensils, tableware, and the like.

While these various prior art camping kitchens have worked with some degree of success, various shortcomings have detracted from their usefulness. For example, one perceived difficulty with folding camping kitchens such as exemplified by the Coleman Deluxe Camping Kitchen, has been the lack of stability of the camping kitchen when it is used on uneven terrain. In this regard, it is well known that most camping sites are often not very level. In view of the narrow width and the longer length dimensions of these camping kitchens, the camping kitchens tend to be unstable, unless they are placed on a nearly horizontal surface.

Yet another shortcoming with the prior art camping kitchens such as what has been discussed above relates to their overall configuration. In this regard, the camping kitchens that are commercially available are typically designed to be deployed in one configuration only. More specifically, they do not provide a convenient means whereby the camping kitchen can be deployed in alternative arrangements to address user preferences such as to accommodate left and right handed users, or to further allow the user to expand or otherwise rearrange the components to fit the user's preference or to meet the needs of a specific outside event.

A versatile and portable kitchen which addresses the perceived shortcomings in the prior art products and practices employed heretofore is the subject matter of the present application.

SUMMARY OF THE INVENTION

Therefore, one aspect of the present invention is to provide a portable kitchen which includes a kitchen surface having a food preparation area; and first and second sink areas defined by the kitchen surface; and a heat resistant surface which can be releasably mounted in a plurality of operable orientations relative to the kitchen surface.

Another aspect of the present invention is to provide a portable kitchen which includes a kitchen surface having top and bottom surfaces, a peripheral edge, first and second ends, and a longitudinal line of reference, and wherein the top surface defines a food preparation area located adjacent to the first end of the kitchen surface, a first sink area juxtaposed relative to the food preparation area, and a second sink area located adjacent to the second end of the kitchen surface, and in spaced relation relative to the first sink area, and wherein the peripheral edge of the kitchen surface defines a plurality of mounting stations located adjacent to the first and second ends of the kitchen surface; a plurality of legs moveably mounted near the bottom kitchen surface, and wherein at least one of the legs is adjustable as to length; and at least one heat resistant surface which can be releasably mounted to any one of the plurality of mounting stations and disposed in substantially coaxial or transverse relation relative to the longitudinal line of reference.

Still another aspect of the present invention relates to a portable kitchen which includes a kitchen surface having opposite first and second ends, and top and bottom surfaces, and wherein the kitchen surface has a peripheral surface which extends generally downwardly relative to the top surface, and which defines, with the bottom surface a storage cavity, and wherein the top surface further defines a food preparation area which is located adjacent to the first end of the kitchen surface and which further has a peripheral edge, and a drainage channel is formed into the top surface and which is oriented along at least one of the peripheral edges of the food preparation area, and in fluid draining relation relative thereto, and wherein the top surface further defines a first sink area which is oriented in juxtaposed relation relative to the food preparation area, and wherein the first sink area has a drain aperture formed therein, and wherein the drainage channel is coupled in fluid draining relation relative to the first sink area, and wherein the top surface further defines a second sink area which is located adjacent to the second end of the top surface, and wherein the second sink area has a drain aperture formed therein, and wherein a plurality of posts are mounted on the top surface of the kitchen surface and which surround the respective first and second sink areas, and wherein a plurality of mounting stations are defined about the peripheral surface which extends downwardly relative to the top surface; a plurality of legs moveably mounted near the bottom kitchen surface and which support the kitchen surface in spaced relation relative to a supporting surface, and wherein at least one to the plurality of legs is adjustable as to length; a shelf positioned below and in substantially parallel spaced relation relative to the bottom kitchen surface, and wherein the shelf is borne by the plurality of legs; a faucet assembly releasably mounted on the top kitchen surface and which is operable to deliver a source of water to the respective first and second sink areas; a drain fixture releasably received in each of the respective drain apertures; a supporting surface which has a surface area defined by a peripheral edge, and wherein a plurality of apertures are formed in a pattern about the peripheral edge, and wherein the supporting surface is operable to be positioned in at least partial covering relation relative to one of the first or second sink areas, and wherein the posts mounted on the top surface are received in the apertures formed in the peripheral edge to appropriately position and releasably secure the supporting surface in at least partial covering relation relative to the first or second sink areas; and a heat resistant surface having a first end which releasably engages one of the mounting stations which are defined by the peripheral surface of the kitchen surface, and an opposite second end, and wherein a pair of legs are mounted on the second end of the heat resistant surface, and which support the heat resistant surface in spaced relation relative to a supporting surface, and wherein the heat resistant surface can be located in a plurality of different orientations relative to the kitchen surface.

These and other aspects of the present invention will be discussed in greater detail hereinafter.

BRIEF DESCRIPTION OF THE DRAWINGS

Preferred embodiments of the invention are described below with reference to the following accompanying drawings.

FIG. 1 is a perspective, environmental view of the portable kitchen of the present invention shown in a first configuration.

FIG. 9 is a perspective view of a supporting surface employed with the portable kitchen of the present invention.

FIG. 10 is an environmental, bottom plan view of the portable kitchen of the present invention and which is shown in a folded stored configuration.

DETAILED DESCRIPTION OF THE PREFERRED EMBODIMENTS

Figure 11:
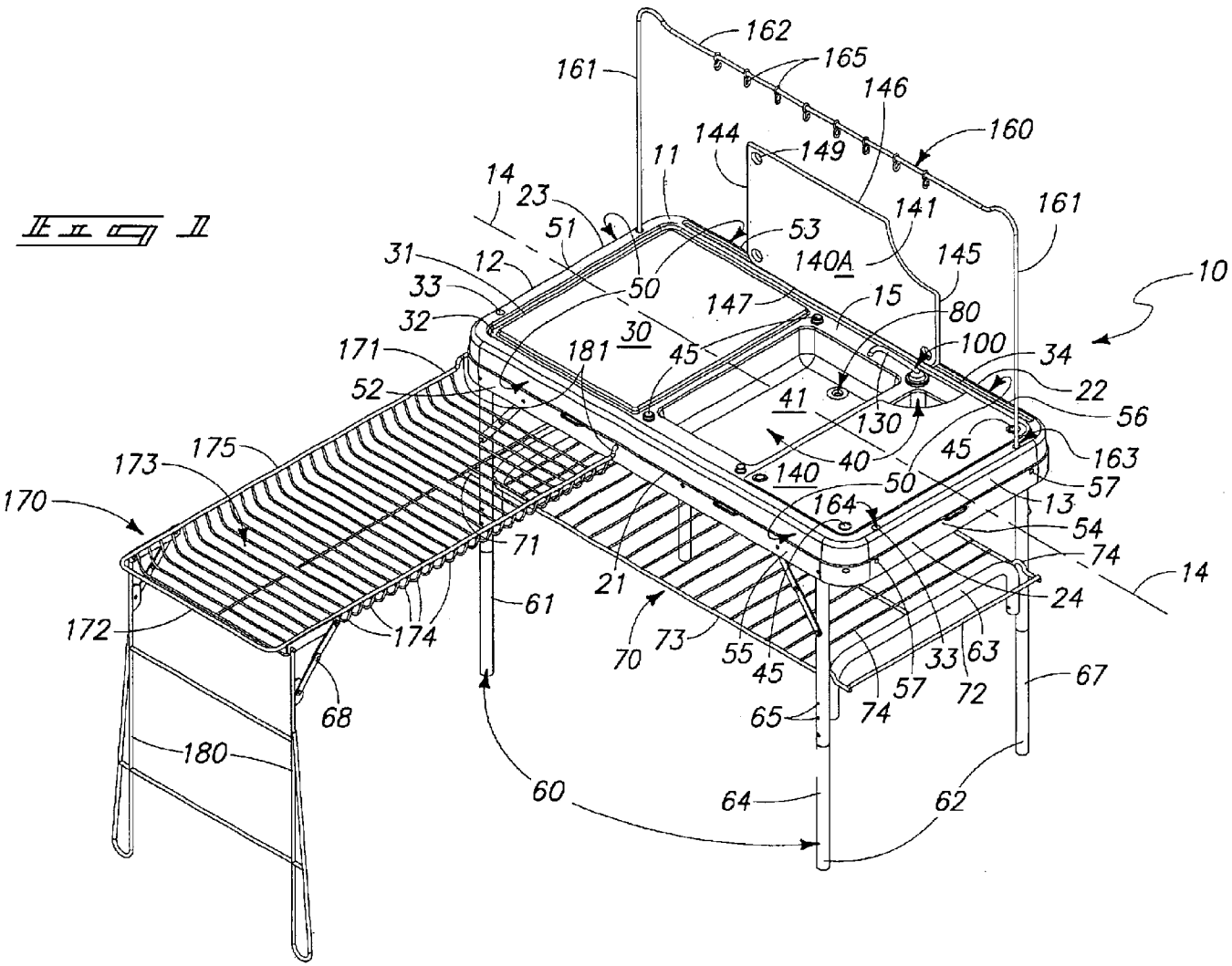
FIG. 11 is a fragmentary, top, plan view of the portable kitchen of the present invention.

This disclosure of the invention is submitted in furtherance of the constitutional purposes of the U.S. Patent Laws "to promote the progress of science and useful arts" (Article 1, Section 8).

The portable kitchen of the present invention is generally indicated by the numeral 10 in FIG. 1, and following. As seen therein, the portable kitchen 10 is useful for various recreational and other outdoor activities such as camping, tailgating, picnicking and the like. The portable kitchen 10 includes a kitchen surface 11 having a first end 12, and an opposite second end 13. A longitudinal line of reference 14 is provided and which extends substantially along the longitudinal axis of the kitchen surface 11. The kitchen surface 11 has a top or upwardly facing surface 15, and an opposite, bottom or downwardly facing surface 20. As seen in FIG. 1 and following, the kitchen surface 11 includes first and second peripheral edges 21 and 22 which have a predetermined major dimension; and third and fourth peripheral edges 23 and 24 which have a second predetermined minor dimension. As seen in the drawings, the kitchen surface 11 is generally substantially rectangular. Further, the first and second peripheral edges 21 and 22 are oriented in substantially parallel spaced relation one to the other, and the third and fourth peripheral edges are oriented in substantially perpendicular relation to the first and second peripheral edges 21 and 22 and are further disposed in substantially parallel spaced relation one relative to the other.

Figure 2:
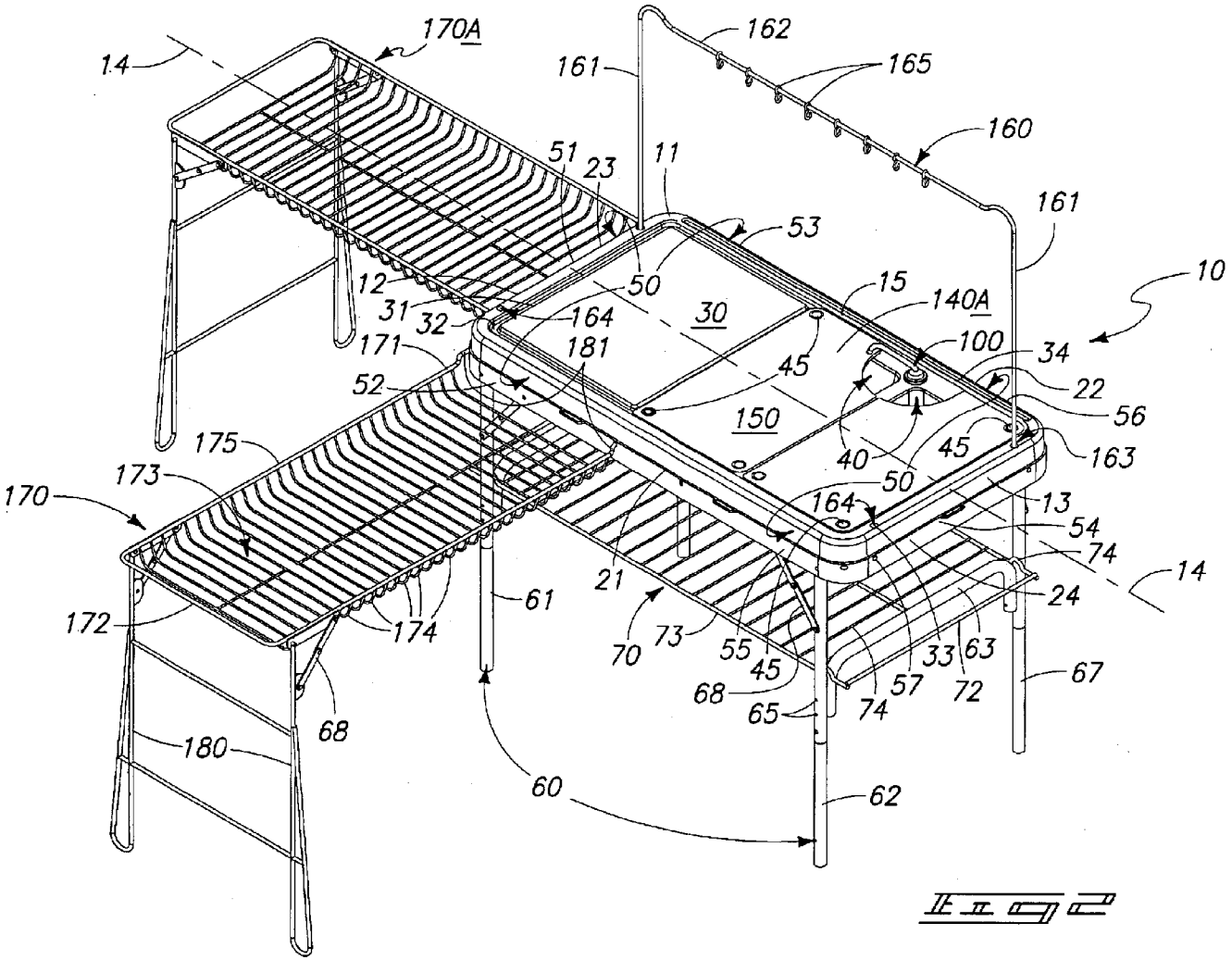
FIG. 2 is a perspective, environmental view of the portable kitchen of the present invention shown in a second possible configuration.
Figure 3:
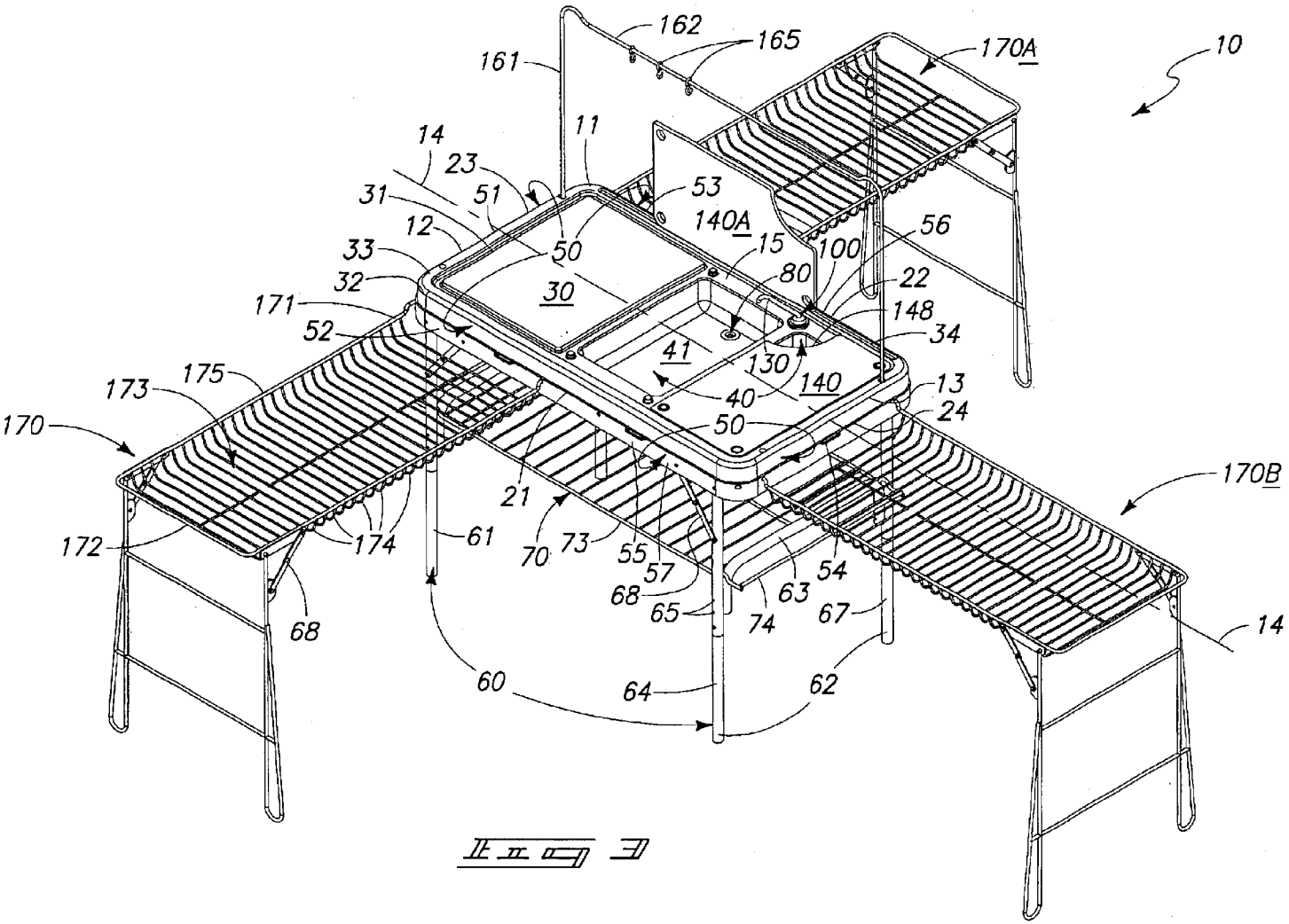
FIG. 3 is a perspective, environmental view of the portable kitchen of the present invention shown in a third possible configuration.
Figure 4:
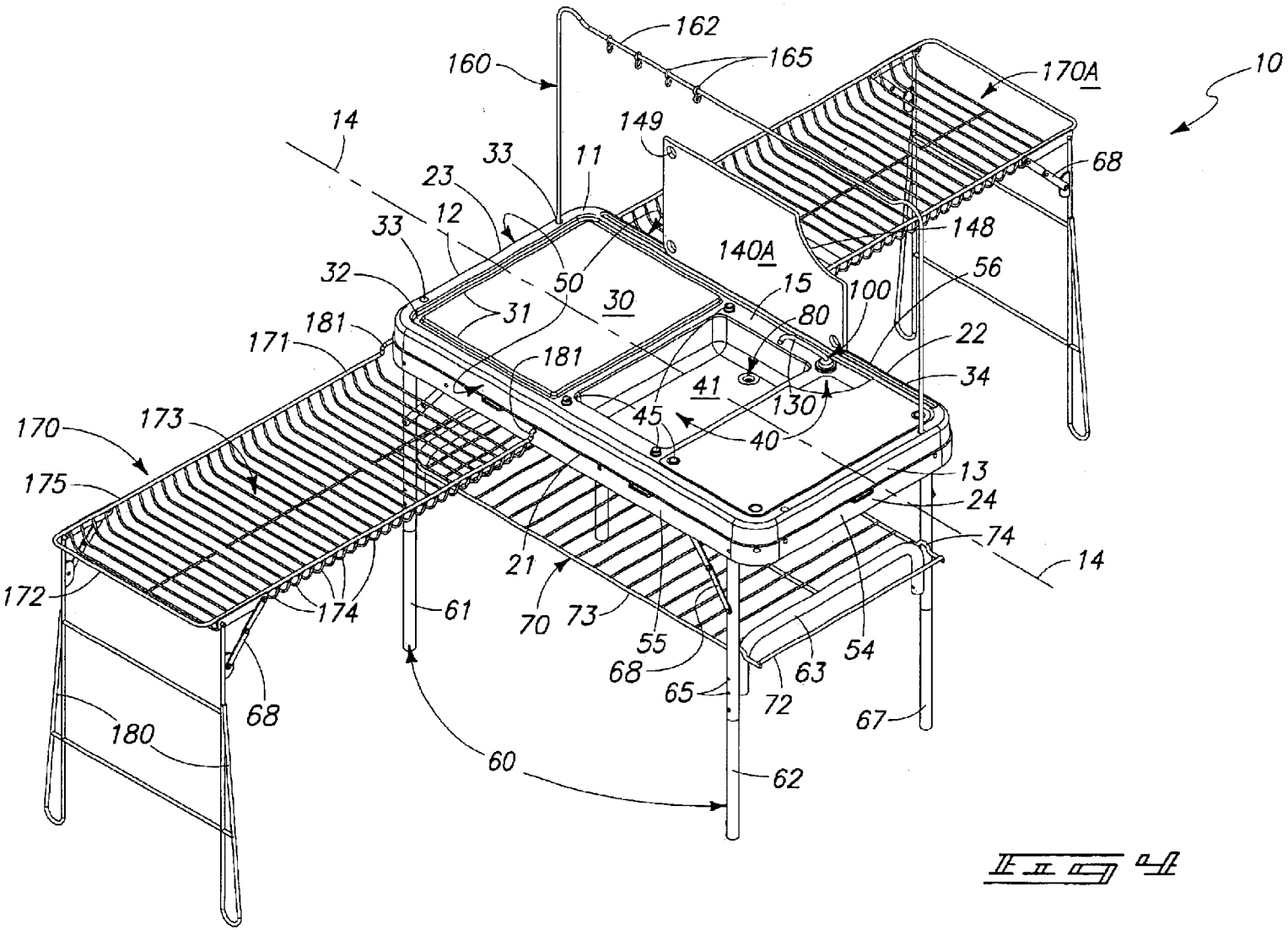
FIG. 4 is a perspective, environmental view of the portable kitchen of the present invention shown a fourth possible configuration.
Figure 5:
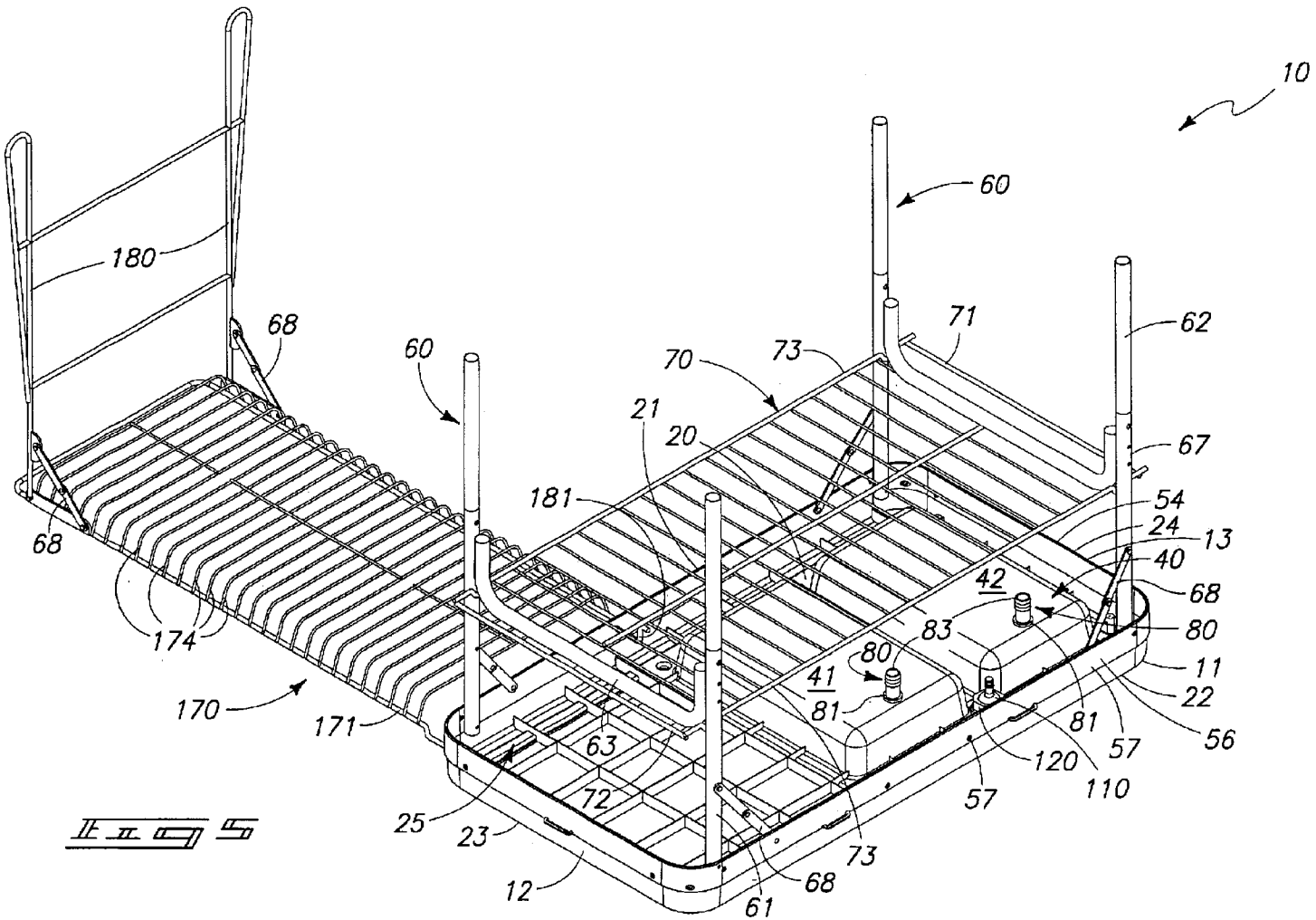
FIG. 5 is a fragmentary, bottom plan view of the portable kitchen as seen in FIG. 1.

As best seen in FIGS. 2 and 10, the first, second, third and fourth peripheral edges 21, 22, 23 and 24, and which extend substantially downwardly relative to the top or upwardly facing surface 15 define a cavity 25 which is operable to receive and store various components of the portable kitchen 10 when they are not in use and to further facilitate the easy transportation of same. Moreover, a handle (not shown) is mounted to the peripheral edge 22 and which facilitates the easy transportation of the portable kitchen 10, when it is being transported in its stored configuration.

Referring still to FIGS. 1–4 and FIG. 11, it will be seen that the kitchen surface 11 includes a food preparation, kitchen surface, or drain board area which is generally indicated by the numeral 30. The food preparation area 30, which is adjacent to the first end 12 of the kitchen surface 11, is defined by a peripheral edge 31. The top surface 15 defines a drainage channel 32 which is located between the peripheral edge 31 and the adjacent first, second and third peripheral edges 21, 22, and 23, respectively. As should be understood, the drainage channel 32 extends at least along a portion of the peripheral edge 31. Still further, the drainage channel is coupled in draining relation relative to a first sink area which will be discussed in greater detail hereinafter. Formed into the top surface 15 of the kitchen surface 11 are a plurality of apertures 33 and which are located at the opposite first and second ends 12 and 13, respectively. As should be understood, these apertures are operable to releasably receive and support a hanging rack which will be discussed hereinafter. Located adjacent to the second peripheral edge 22 and formed or otherwise defined in the top surface 15 is an elongated channel 34. The elongated channel is operable to receive a supporting surface which will also be discussed in greater detail hereinafter. As best seen by reference to FIG. 11, a faucet aperture 35 is formed in the top surface 15 and is operable to receive a faucet assembly which will be discussed in the paragraphs below.

Referring again to FIGS. 1–4 and FIG. 11, the kitchen surface 11 defines a pair of side-by-side sink areas which are generally indicated by the numeral 40. In this regard, the sink areas include a first sink area 41 which is juxtaposed or otherwise adjacent to the food preparation area 30. As earlier discussed, the drainage channel 32 is disposed in draining relation relative to this first sink area 41. Still further, the kitchen surface 11 defines a second sink area 42 which is juxtaposed or adjacent to the second end 13 of the kitchen surface 11, and is disposed in spaced relation relative to the first sink area 41. As illustrated, the first and second sink areas are of substantially identical dimensions, although it should be recognized to one skilled in the art that these sink areas 40 could be formed into different shapes and sizes depending upon an end user's needs. As seen in FIG. 11, the faucet aperture 35 is formed in the top surface 15 at a location where it is between the second peripheral edge 22, and the first and second sink areas 41 and 42. Still referring to FIG. 11, it will be seen that the first and second sink areas 41 and 42 each have a drain aperture 43 formed therein. Yet further, each drain aperture includes a pair of keyways 44. Referring now to FIGS. 1–4, for example, a plurality of posts 45 are formed or otherwise mounted on the top surface 15 and which extend substantially normally upwardly relative thereto. The plurality of posts 45 which are mounted on the top surface 15 surround, in part, the respective first and second sink areas 41 and 42. The purpose of these posts will be discussed in greater detail hereinafter. On top of each of the posts is a locking member with an off center pivot point (not shown) and which serves to releasably lock a supporting surface in place. These supporting surfaces will be discussed in the paragraphs below.

Referring still to FIGS. 1–4, the portable kitchen 10 includes a plurality of mounting stations 50 hereinafter designated as first, second, third, fourth, fifth and sixth mounting stations 51–56, respectively. The mounting stations 50 are located at given locations along the first, second, third and fourth peripheral edges 21–24, respectively. As seen, the first mounting station 51 is located along the third peripheral edge 23 at the first end 12 of the kitchen surface 11. Still further, the second and third mounting stations are located adjacent to the first end 12 of the kitchen surface 11 and along the first and second peripheral edges 21 and 22, respectively. Yet further, the fourth mounting station 54 is located along the fourth peripheral edge 24 and adjacent the second end 13 of the kitchen surface 11. The fifth and sixth mounting stations 55 and 56 are located along the first and second peripheral edges 21 and 22 and adjacent the second end 13 of the kitchen surface 11. As seen in the drawings, each of the mounting stations 50 comprise a pair of apertures 57 which are operable to receive and support one end of a heat resistant surface which will be discussed in greater detail hereinafter. As will be recognized by a study of FIGS. 1–4, the various mounting stations provide a convenient means by which the portable kitchen 10 can be configured or otherwise deployed into a number of arrangements to meet an end user's needs. This aspect of the invention will be discussed hereinafter.

Referring more specifically to FIGS. 1–5, the portable kitchen 10 is supported in spaced relation relative to an underlying supporting surface such as the surface of the earth, or the like, by a plurality of legs which are generally indicated by the numeral 60. In this regard, the portable kitchen 10 has a first pair of legs 61 which are hingedly or otherwise moveably mounted at a location which is adjacent to the bottom or downwardly facing surface 20, and on the first and second peripheral edges 21 and 22 which forms, in part, a portion of the cavity 25 which is most clearly seen in FIG. 5. The first pair of legs 61 is moveably mounted in a location which is closely adjacent to the first end 12 of the kitchen surface 11. Yet further, the second pair of legs 62 is located in adjacent, closely spaced relation relative to the second end 13 of the kitchen surface 11. Each of the first or second pairs of legs 61 and 62 includes a reinforcing cross bar 63 which provides added strength and rigidity. Still further, the cross bar supports a shelf which will be discussed below. As best seen by reference to FIG. 1, at least one of the first or second pairs of legs 61 or 62 is adjustable as to length in order to provide a convenient means by which the portable kitchen 11 may be readily utilized on uneven or non-horizontal surfaces or terrain. As should be understood, and as seen by the drawings, at least one of the plurality of the legs has an adjustable leg portion 64 which is received internally of one of the pairs of legs and which has a detent which may be removeably received in various apertures 65 which are formed in the respective legs 61 or 62 in order to adjust the leg as to length. The apertures 65 are shown in FIG. 1 and following. The respective pairs of legs 61 and 62 are moveable from a first folded position 66, where they are received in the cavity 25 (FIG. 10), to a second, operational position 67, where the respective pairs of legs 61 or 62 are operable to support the kitchen surface 11 in an operational orientation relative to a supporting floor or the surface of the earth. A folding or hingedly locking brace member 68 is provided and which maintains the respective pairs of legs in the second operational position.

As best seen by references to FIGS. 1–4, a shelf, which is generally indicated by the numeral 70, is positioned below, and in substantially parallel, spaced relation relative to the bottom surface 20, of the kitchen surface 11. As illustrated, the shelf 70 is supported in this spaced relationship by the plurality of legs 60. The shelf 70 has opposite first and second ends 71 and 72. The shelf 70 also has two elongated support members 73 which are disposed in spaced relation one relative to the other. An indentation or receiving station is formed in each of the support members 73 at a location near the first and second ends 71 and 72 of the shelf 70. As illustrated in FIG. 1, for example, it will be seen that the indentation or receiving station is operable to rest in mating relationship against the reinforcing cross-bar 63 at a location where it joins the individual legs forming the first and second pairs of legs 61 and 62. Referring now to FIG. 10, it will be seen that the shelf 70 is sized to be received in the cavity 25 when it is no longer in use, or being stored for transport.

Figure 6:
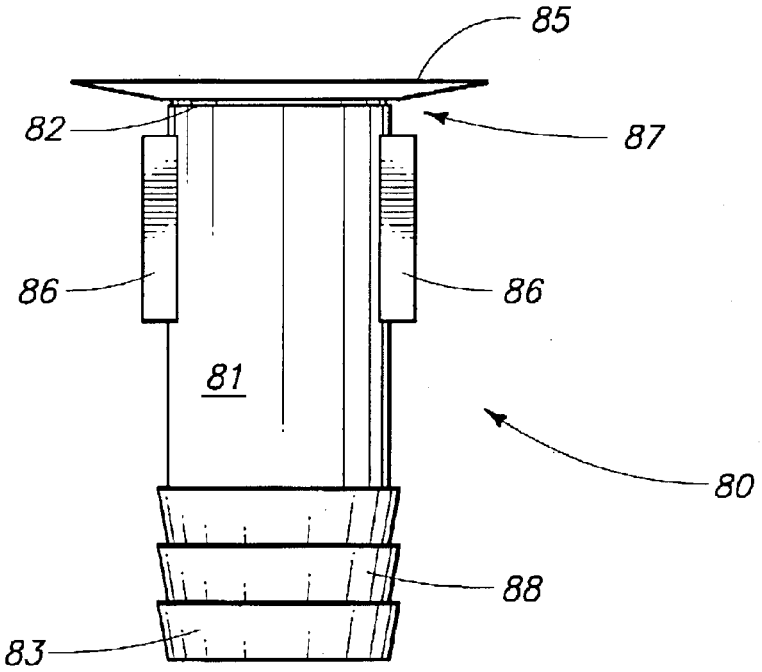
FIG. 6 is a side elevation view of a drain fixture which is utilized in the portable kitchen of the present invention.
Figure 7:
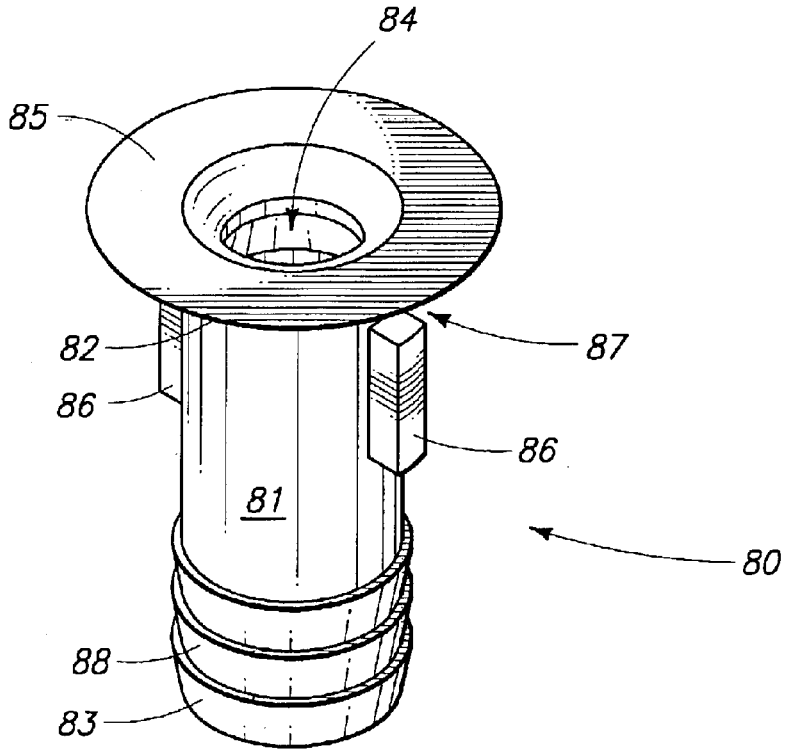
FIG. 7 is a perspective view of the drain fixture as shown in FIG. 6.

Referring more specifically now to FIGS. 6 and 7, a drain fixture, which is generally indicated by the numeral 80, is provided and which is operable to be releasably mounted in draining relation relative to the respective first and second sink areas 41 and 42 respectively. In this regard, the drain fixture 80 is received in the respective drain apertures 43 which are defined by the first and second sink areas 41 and 42. In this regard, the drain fixture 80 has a main body 81, having a first end 82 and an opposite second end 83. The main body 81 defines a fluid passage 84 which extends between the first and second ends 82 and 83. As seen in FIGS. 6 and 7, a circumscribing flange member 85 is made integral with the main body 81 and extends generally normally or radially outwardly relative to the first end 82. A pair of keys 86 are mounted on the main body 81 and are disposed in spaced relation relative to the flange member 85. As seen in FIG. 6, a gap 87 is defined between the respective keys 86 and the flange member 85. Yet further, the main body 81 includes a plurality of irregular or ridge like surfaces 88 which are formed about the second end 83. These irregular or roughened surfaces 88 facilitates the coupling of the drain fixture 80 to a flexible hose (not shown) which is operable to drain water, soap suds, and the like away from the sink areas 40 when the portable kitchen is, in use. This flexible hose may be further coupled to a portable waste water container (not shown) which receives the waste water, and any food debris drained from the sink areas 40. This permits a user to easily transport this waste water safely away from the portable kitchen 10 for appropriate disposal. To utilize the drain fixture 80, the main body 81 is appropriately aligned so that it may be, received in and through the drain aperture 43. Further, the keys 86 are aligned to be received through the keyways 44 which are defined by the respective first and second sink areas 41 and 42. Thereafter, rotation of the main body 81 results in the respective keys releasably engaging or capturing the bottom surface 20 of the kitchen surface 11 in the gap 87 thereby releasably securing the drain fixture in draining relation relative to the respective first and second sink areas 41 and 42. As will be recognized by a study of FIG. 6, a suitable, flexible gasket (not shown) may be received about the main body 81 and located adjacent to the flange member in order to provide a substantially fluid impervious seal thereabout.

Referring more specifically to FIGS. 1–4 and FIG. 8, a faucet assembly which is generally indicated by the numeral 100 is releasably mounted on the top surface 15 of the kitchen surface 11. The faucet 100 is operable to deliver a source of water, not shown, to the first and second sink area 41 and 42, respectively. The faucet assembly is more clearly shown in the exploded view of FIG. 8. In this view, it will be seen that the faucet assembly 100 includes a spiket housing 101. The spiket housing has a main body 102 having a first end 103. A circumscribing flange 104 is formed about the main body 102 and is located adjacent the first end 103. Still further, the main body has a second end 105. The main body 102 defines a cavity 106. Still further, a plurality of screw threads are formed about the main body 102 at the second end 105 thereof.

Figure 8:
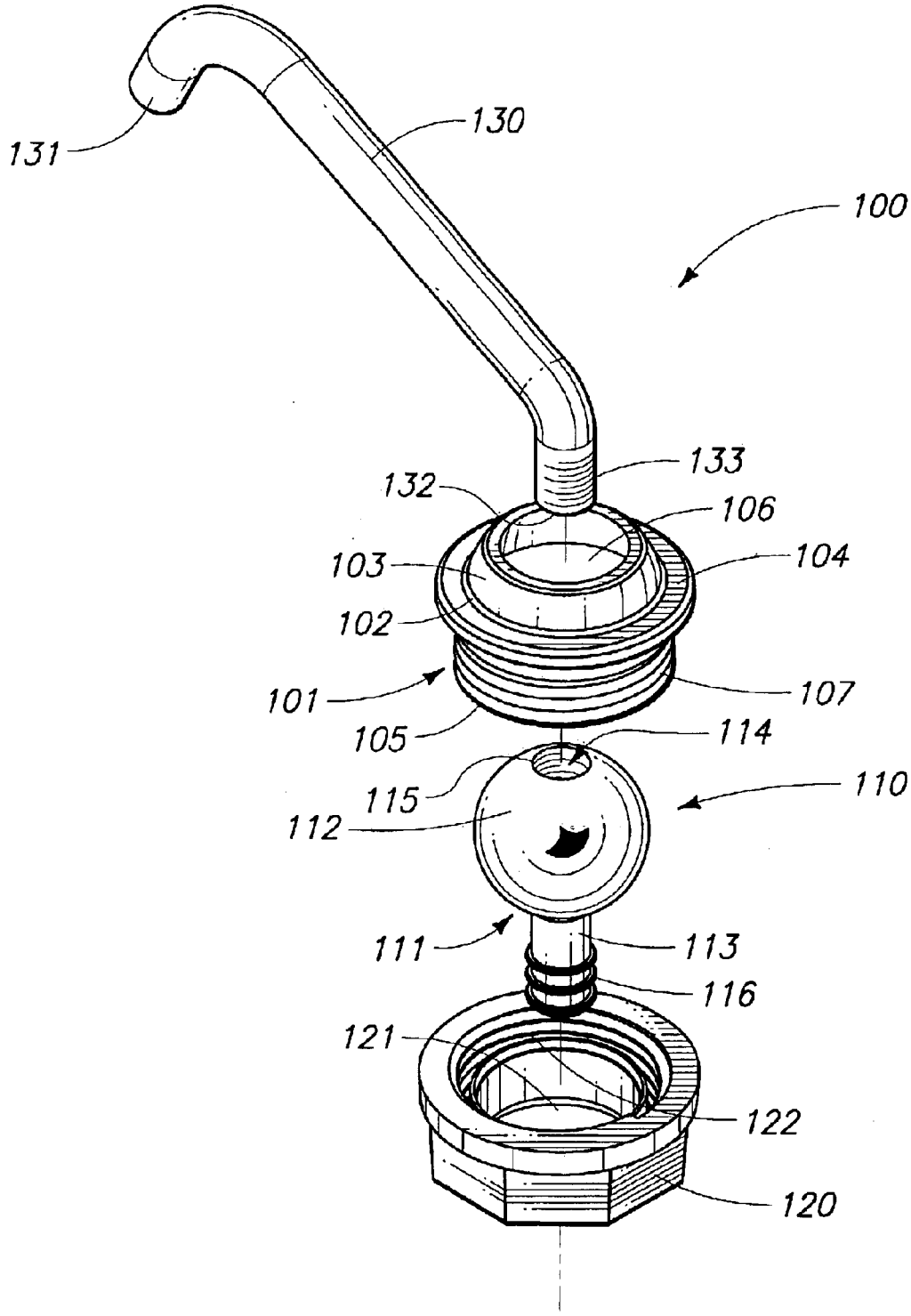
FIG. 8 is a fragmentary, exploded, side elevation view of a faucet assembly employed with the portable kitchen of the present invention.
Figure 11:
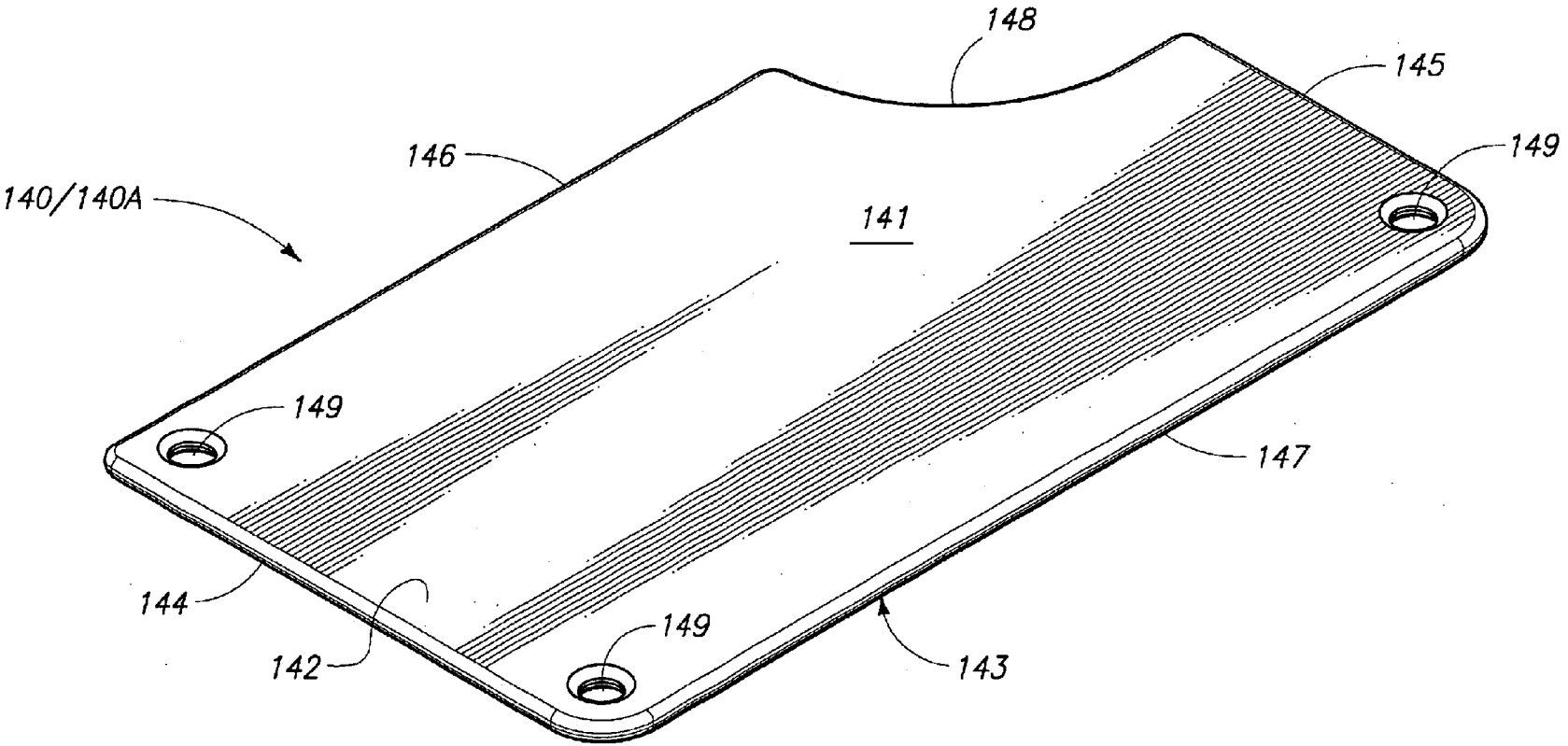
Figure 11:
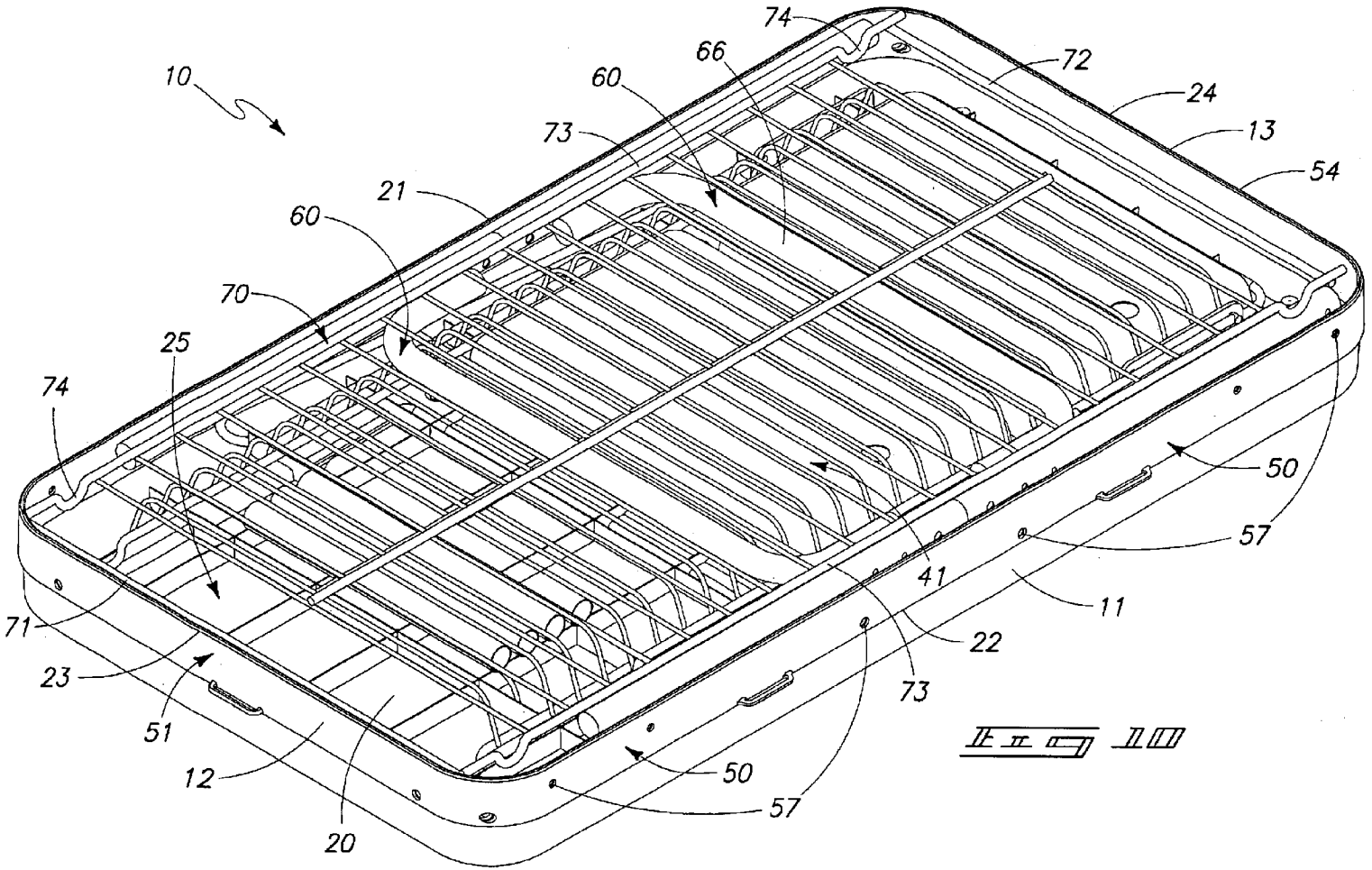
Figure 11:
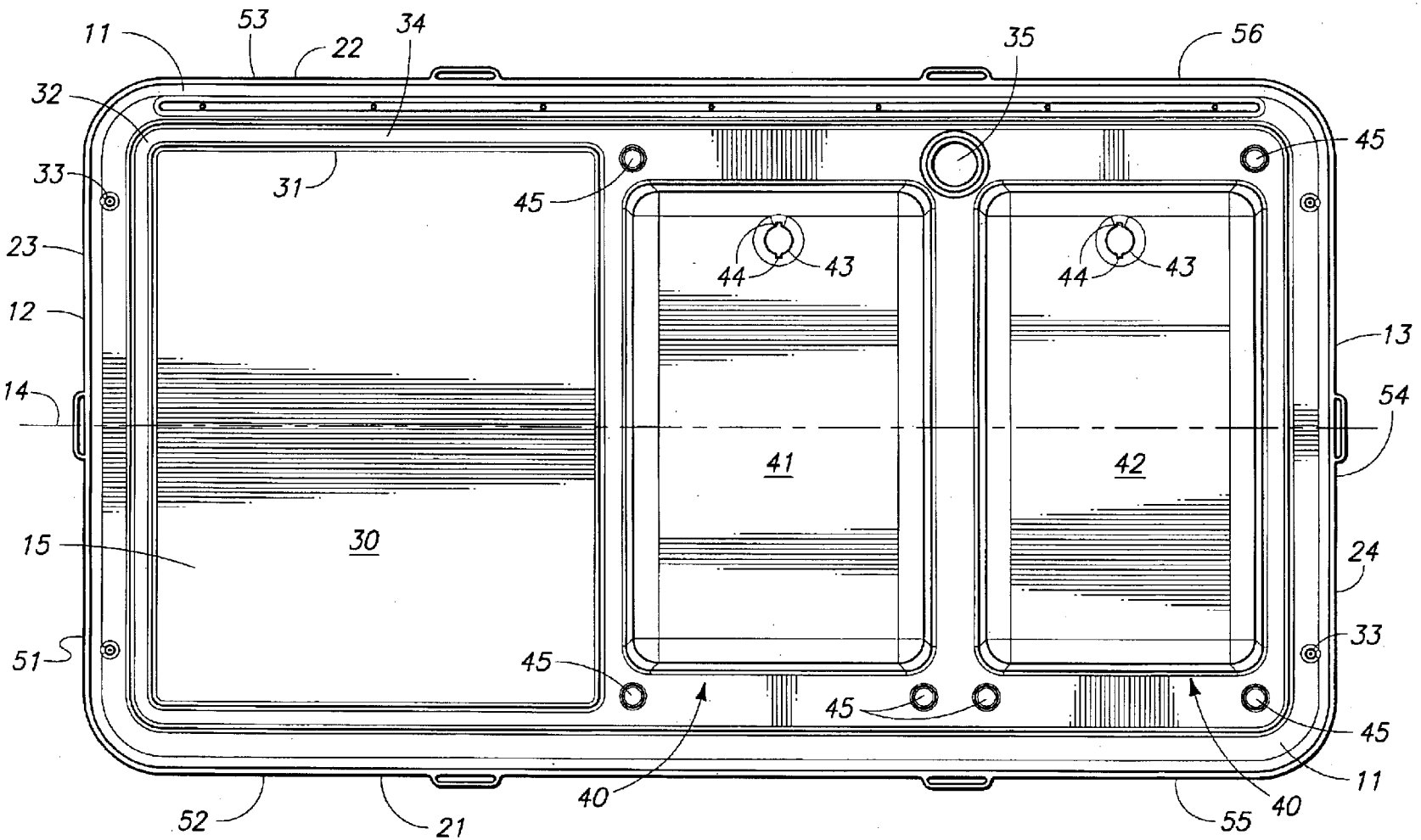

A ball spiket 110 is received in the cavity 106 which is defined by the main body 102 of the spiket housing 101. As seen in FIG. 8, the ball spiket has a main body 111 having a ball portion 112 and a cylindrical portion 113 which extends substantially radially outwardly relative thereto. A fluid passageway 114 is defined by the main body 111 and the cylindrical portion 113, and which extends through the ball portion 111 and the cylindrical portion 113. As should be understood, internal threads 115 are formed in the ball portion 112 which defines, in part, the fluid passageway 114. Still further, a hose or flexible conduit engagement surface 116 is formed on the outside surface of the cylindrically shaped portion 113 and is operable to releasably engage a flexible hose or conduit such that a source of water (not shown) may be coupled in fluid flowing relation relative to the ball spiket 110.

A spiket housing nut 120 is provided and which has a passageway formed therein. Still further, a plurality of internal threads 122 are defined by the spiket housing nut. As should be understood, the ball spiket 110 is received in the cavity 106 and the second end 105 of the main body 102 is sized to be received through the faucet aperture 35 which is formed in the kitchen surface 11. The circumscribing flange rests on the kitchen surface 11. Once received through the kitchen surface 11, the spiket housing nut 120 threadably mates with the second end 105 thereby capturing or otherwise releasably securing the ball spiket 110 in the cavity 106. This spiket housing nut further secures the main body 102 of the spiket housing 101 to the kitchen surface 11 and in substantially occluding relation relative to the faucet aperture 35. The cylindrical portion 113 of the ball spiket 110 extends outwardly or downwardly relative to the bottom kitchen surface 20 so that it may be readily accessed. As seen in FIG. 8, a faucet tube 130 is provided and which has a first end 131, and a second end 132. The faucet tube defines a fluid passageway which is coupled in fluid flowing relation relative to the fluid passageway 114 which is defined by the ball spiket 110. A plurality of external threads 133 are formed about the second end 132, and are operable to threadably mate with the internal threads 115 which are located in the fluid passageway 114 of the ball portion 112. As such, the faucet tube 130 can be threadably mated and thus fluidly coupled to the ball spiket 110. As will be appreciated, the ball spiket provides a convenient means whereby the faucet tube 130 can be conveniently turned from side to side so as to permit the faucet assembly 100 to deliver a source of water or other fluid to either of the first or second sink areas 41 and 42, respectively.

Referring now to FIGS. 1–4 and 9, the portable kitchen 10 of the present invention also includes at least one supporting surface which is generally indicated by the numeral 140. The supporting surface 140 has a main body 141 having an upwardly facing surface 142 and an opposite downwardly facing surface 143. The supporting surface 140 is operable to be positioned in at least partially covering relation relative to the first and/or second sink areas 41 and 42. As seen in FIG. 2, a second supporting surface 140A may also be provided and which is operable to be placed in at least partial covering relation relative to the remaining sink area 40 for the purposes which will be described hereinafter. The supporting surface 140 or 140A has a thickness dimension which permits it to be received, in part, in the elongated channel 34 where it may be temporarily stored in a position where it can be readily reached by an end user utilizing the portable kitchen 10. The supporting surface 140 has a first peripheral edge 144, and an opposite, substantially parallel, second peripheral edge 145. Still further, the main body 141 has a third peripheral edge 146, and an opposite substantially parallel fourth peripheral edge 147. In addition, each of the supporting surfaces 140 and 140A have a fifth substantially arcuately shaped or recessed edge 148 as seen most clearly by reference to FIG. 9. Yet further, a plurality of apertures 149 are positioned about the first and fourth peripheral edges as illustrated. These apertures are oriented such that they may receive the individual posts 45 which are mounted on the kitchen surface 11. When the posts are received in the individual apertures 149, the supporting surfaces 140 or 140A are substantially secured in a given location, and in at least partial covering relation relative to the first and second sink areas 41 and 42. The respective supporting surfaces are releasably locked in place by locking members which are moveably mounted on the top of each of the posts 45. As illustrated most clearly by references to FIGS. 1–4, the fifth substantially arcuately shaped peripheral edge 148 provides a convenient means whereby access to the underlying sink areas 41 and 42 is assured while the supporting surface is in partial covering relation relative to one of the sink areas 40. Still further, these same arcuately or recess shaped edges provide a space or a gap which permits the faucet assembly 100 to deliver fluid to the underlying sink areas 40 without removing the overlying supporting surface 140 or 140A.

In addition to the foregoing, the supporting surface 140, when located in partial covering relation relative to the respective sink areas 41 and 42, is oriented in a substantially coplanar orientation relative to the food preparation area 30. Therefore, as seen in FIG. 1, it will be recognized that the supporting surface 140 is disposed in spaced substantially coplanar relation relative to the food preparation area 30. However, and as illustrated in FIG. 2, the supporting surface 140A may be located in a juxtaposed substantially coplanar orientation relative to the food preparation area 30 when the supporting substrate 140A is located in at least partial covering relation relative to the first sink area 41. Still further, and referring to FIG. 2, it will be recognized that when the first and second supporting surfaces 140 and 140A are utilized, a substantially continuous and coplanar surface 150 is defined, and which extends substantially from the first end 12, to the second end 13 of the kitchen surface 11.

As best illustrated in FIGS. 1–4, a hanging rail 160 is provided and which can be releasably supported in a substantially vertical orientation relative to the top or upwardly facing surface 15 of the kitchen surface 11. The hanging rail 160 enables a user to hang various utensils, cups, pots, pans, outdoor lanterns, and other articles above the kitchen surface 11. The hanging rail will accommodate hooks 165 of assorted designs and which can engage the handles of various pots, pans, and other objects of interest which might be used in a remote outdoor environment. The hanging rail includes a pair of substantially, vertically oriented support members 161 which are joined to a substantially horizontal member 162. The hanging rail 160 is operable to be located in either a first position 163, where it is located adjacent to the second peripheral edge 22 as illustrated, or the first peripheral edge 21, based upon the needs or desires of the end user. As will be recognized, a second hanging rail may be provided and which may be located in both positions depending upon the needs and desires of the end user. The hanging rail 160 is maintained in a substantially, vertical orientation relative to the kitchen surface 11 by inserting the individual, vertically oriented members 161 in the respective apertures 33 which are formed in the top surface 15 of the kitchen surface 11.

The portable kitchen 10 includes at least one heat resistant surface 170 which can be releasably mounted to any one of the plurality of mounting stations 50 and disposed in substantially coaxial or transverse relation relative to the longitudinal line of reference 14. In this regard, the portable kitchen 10 may accommodate more than one heat resistant surface 170. As seen by reference to FIGS. 2, 3 and 4, additional heat resistance surfaces 170A, B and C are mounted in various orientations relative to the kitchen surface 11 and to the various mounting stations 51–56, respectively. As will be recognized, this feature of the invention allows the portable kitchen to be deployed in a wide variety of ways to serve outside gatherings and parties of various sizes. As will be recognized from a study of the drawings, the heat resistant surface has a first end 171, and an opposite second end 172. The heat resistant surface has a supporting surface 173 here illustrated as comprising a plurality of spaced cross members 174 which are fabricated from a metal and which resists heat which may be generated by a gas stove or the like. As illustrated, the supporting surface 173 has a raised peripheral edge 175 which provides a convenient means by which to prevent a gas stove or other articles from sliding or otherwise falling off of the supporting surface 173. The heat resist surface has a pair of legs 180 which are movably mounted to the second end 172 thereof. As will be recognized, the heat resistant surface is sized so that it may be received and stored in the cavity 25 when it is not in use, or when it is being transported. As will be recognized, the pair of legs 180 are operably folded for easy storage. As will be seen from the drawings, a pair of engagement members 181 are mounted on or made integral with the first end 171 and are individually received in the aperture 57 which form the respective mounting stations 51–56. The heat resistant surface 170 can rotate slightly about the respective mounting stations 50 such that the portable kitchen 10 can be deployed on uneven surfaces without risk that the portable table may fall over. While the present heat resistant surface 70 is illustrated as having a supporting surface comprising a plurality of spaced cross members 174, it will be recognized that the supporting surface may also be fabricated from a substantially continuous sheet of metal or other heat resistant material. Yet further, additional kitchen surface space (not shown) may be fabricated in a fashion similar to the heat resistant surface and which has a continuous surface and which could be releasably coupled to the respective mounting stations 50. As seen by reference to FIGS. 2, 3 and 4, the portable kitchen of the present invention permits a user to create kitchen arrangements of various shapes and sizes to accommodate any end user preferences or perceived needs.

Operation

The operation of the described embodiment of the present invention is believed to be readily apparent and is briefly summarized at this point. A portable kitchen 10 of the present invention has been shown and described and which includes a kitchen surface 11 having a food preparation area 30, and first and second sink areas 41 and 42, respectively, and which are defined by the kitchen surface. Still further, the portable kitchen 10 includes a heat resistant surface 170 which can be releasably mounted in a plurality of operable orientations relative to the kitchen surface 11.

More specifically the portable kitchen 10 of the present invention includes a kitchen surface 11 having top and bottom surfaces 15 and 20, peripheral edges 21–24, first and second ends 12 and 13, and a longitudinal line of reference 14. The top surface defines a food preparation area 30 which is located adjacent to the first end 12 of the kitchen surface, and a first sink area 411 is juxtaposed relative to the food preparation area. A second sink area 42 is located adjacent to the second end 13 of the kitchen surface, and is disposed in spaced relation relative to the first sink area. The peripheral edge 21–24 of the kitchen surface 11 defines a plurality of mounting stations 50 which are located adjacent to the first and second ends 12 and 13 of the kitchen surface 11. A plurality of legs 60 are moveably mounted on or near the bottom surface 20 of the kitchen surface 11. At least one of the legs 60 is adjustable as to length. Still further, at least one heat resistant surface 170 can be releasably mounted to any one of the plurality of mounting stations 50 and disposed in substantially coaxial or transverse relation relative to the longitudinal line of reference 14. As illustrated, and as discussed above, a drain fixture 80 is provided and which is operable to be positioned in releasable draining relation relative to each of the sink areas 41 and 42. The present, portable kitchen 10 further includes a shelf 70 which is positioned below, and in substantially parallel, spaced relation relative to the bottom surface 20 of the kitchen surface 11. The shelf is borne or otherwise supported by the plurality of legs 60. The portable kitchen 10 further includes a faucet assembly 100 which is releasably mounted on the top kitchen surface 15 and which is operable to deliver a source of water to the respective first and second sink areas 41 and 42. A supporting surface 140 is provided and which has an upwardly facing surface 142 which is defined by peripheral edges 144–148. The supporting surface 140 is operably positioned in at least partial covering relation relative to one of the first or second sink areas 41 and 42. Posts 45, which are mounted on, or made integral with the top surface 15, are received in apertures 149 that are formed in the peripheral edge of the supporting surface 140. The respective posts are operable to secure the supporting surface 140 in at least partial covering relation relative to the first or second sink areas 41 and 42.

As earlier discussed, the camping kitchen 10 permits an end user to use a plurality of heat resistant surfaces 170, as shown in the drawings, to create a kitchen surface arrangement to meet any desired needs. Still further a second supporting surface 140A may be provided, and which can be oriented in at least partial covering relation relative to a remaining sink area 40. When two supporting surfaces 140 and 140A are provided, a substantially continuous and coplanar supporting surface 150 is defined and which extends between the first and second ends 12 and 13 of the kitchen surface 11. A handle member (not shown) may be releasably affixed to one of the peripheral edges of the kitchen surface 11, thereby permitting a user to easily grasp and transport same. Yet further, a bag may be provided and which receives the entire folded and stored portable kitchen as seen in FIG. 10. This bag would permit an attached handle affixed to the portable kitchen to extend through an aperture formed in the bag thereby providing a convenient means for handling and carrying the portable kitchen 10.

Therefore it will be seen that the portable kitchen of the present invention provides a convenient means whereby a user may set up an outdoor portable kitchen with ease and convenience not possible heretofore. The present portable kitchen further provides an end user with an opportunity to set up the portable kitchen in various configurations, and further avoids the many shortcomings in the prior art assemblies which have been utilized heretofore.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A portable camping kitchen, comprising:

a kitchen surface having a food preparation area and first and second sink areas defined by the kitchen surface; and a heat resistant surface which can be releasably mounted in a plurality of different operable substantially horizontal orientations relative to the kitchen surface.

2. A portable camping kitchen as claimed in claim 1, and further comprising a faucet assembly releasably mounted on the kitchen surface.

3. A portable camping kitchen as claimed in claim 1, and wherein the kitchen surface has an upwardly facing surface which defines the food preparation area and the first and second sink areas, and a downwardly facing surface which defines a cavity which receives and stores the heat resistant surface when it is not in use.

4. A portable camping kitchen as claimed in claim 1, and wherein the first and second sink areas are oriented in side by side relation.

5. A portable camping kitchen as claimed in claim 1, and wherein the food preparation area has a peripheral edge, and wherein the kitchen surface defines a drainage channel which is located adjacent to the peripheral edge of the food preparation area and which is coupled in fluid draining relation relative to one of the first or second sink areas.

6. A portable camping kitchen as claimed in claim 1, and wherein the first and second sink areas are disposed in side by side relation, and wherein a faucet assembly is releasably mounted on the kitchen surface and located in a position where the faucet may deliver a fluid to either the first or the second sink areas.

7. A portable camping kitchen as claimed in claim 1, and wherein a collapsible handle is mounted on the kitchen surface.

8. A portable camping kitchen as claimed in claim 1, and wherein the first and second sink areas each define a drain aperture, and wherein a drain fixture is releasably received in each of the drain apertures; and further comprising a supporting surface which can be releasably mounted on the kitchen surface and disposed in at least a partial covering relation relative to one of the first or second sink areas, and wherein the supporting surface has a recessed edge which facilitates access to the at least one of the first or second sink areas when the supporting surface is disposed in at least partial covering relation relative to at least one of the first or second sink areas.

9. A portable camping kitchen as claimed in claim 8, and wherein the drain fixture has a generally cylindrically shaped main body with opposite first and second ends, and which defines a fluid passageway which extends from the first to the second end thereof, and wherein the drain fixture has a flange member which is mounted on the first end of the main body and which extends substantially radially outwardly relative thereto, and wherein the drain apertures each define a keyway, and wherein the cylindrically shaped main body defines a key which is disposed in spaced relation relative to the flange member, and which can be received through the keyway and rotated to a position where the drain assembly is releasably secured in draining relation relative to the respective sink areas.

10. A portable camping kitchen as claimed in claim 1, and wherein the heat resistant surface has opposite first and second ends, and wherein the first end is releasably mounted on the kitchen surface, and wherein a pair of legs are moveably mounted on the second end of the heat resistant surface.

11. A portable camping kitchen as claimed in claim 10, and wherein the heat resistant surface has an elevated peripheral edge.

12. A portable camping kitchen as claimed in claim 1, and wherein a plurality of legs are moveably mounted on the kitchen surface, and wherein a shelf is positioned below the kitchen surface and supported in substantially parallel, spaced relation relative thereto by the plurality of legs.

13. A portable camping kitchen as claimed in claim 12, and wherein the respective legs are adjustable as to length.

14. A portable camping kitchen as claimed in claim 1, and further comprising a hanging rail which is releasably mounted on the kitchen surface and which extends substantially normally upwardly relative thereto.

15. A portable camping kitchen as claimed in claim 14, and wherein the kitchen surface has first and second edges each having a major dimension, and third and fourth edges each having a minor dimension, and wherein the hanging rail may be releasably mounted on the kitchen surface at a location adjacent to the first and/or second edges.

16. A portable camping kitchen as claimed in claim 1, and wherein the kitchen surface has opposite first and second ends, a longitudinal line of reference, and a peripheral edge, and wherein the peripheral edge defines a plurality of mounting stations to which the heat resistant surface can be releasably mounted.

17. A portable camping kitchen as claimed in claim 16, and wherein a plurality of heat resistant surfaces can be releasably mounted on the kitchen surface.

18. A portable camping kitchen as claimed in claim 16, and wherein the heat resistant surface can be selectively releasably mounted in a substantially coaxially or a substantially transversely related orientation relative to the longitudinal line of reference.

19. A portable camping kitchen as claimed in claim 18, and wherein the heat resistant surface is located adjacent to the first or second end of the kitchen surface when it is releasably mounted in substantially transverse relation relative to the line of reference.

20. A portable camping kitchen, comprising:

a kitchen surface having top and bottom surfaces, a peripheral edge, first and second ends, and a longitudinal line of reference, and wherein the top surface defines a food preparation area located adjacent to the first end of the kitchen surface, a first sink area juxtaposed relative to the food preparation area, and a second sink area located adjacent to the second end of the kitchen surface, and in spaced relation relative to the first sink area, and wherein the peripheral edge of the kitchen surface defines a plurality of mounting stations located adjacent to the first and second ends of the kitchen surface and wherein the respective mounting stations are each defined by a pair of apertures which extend through the peripheral edge;

a plurality of legs moveably mounted at a location which is adjacent to the bottom surface of the kitchen surface, and wherein at least one of the legs is adjustable as to length; and at least one heat resistant surface which can be releasably mounted to any one of the plurality of mounting stations and disposed in substantially coaxial or transverse relation relative to the longitudinal line of reference and in a substantially horizontal orientation.

21. A portable camping kitchen as claimed in claim 20, and wherein a plurality of heat resistant surfaces can be releasably mounted to the kitchen surface substantially simultaneously.

22. A portable camping kitchen as claimed in claim 20, and further comprising a faucet assembly which is releasably mounted on the kitchen surface and which can be releasably coupled in fluid flowing relation relative to a remote water source, and wherein the faucet is configured to deliver the source of water to either the first or second sink areas.

23. A portable camping kitchen as claimed in claim 22, and wherein the food preparation area has a peripheral edge, and wherein the primary kitchen surface defines a drainage channel which extends along and adjacent to at least a portion of the peripheral edge of the food preparation area, and which is further coupled in fluid draining relation relative to the first sink area.

24. A portable camping kitchen as claimed in claim 20, and wherein the bottom surface of the kitchen surface defines a cavity, and wherein the portable kitchen further comprises a shelf which is positioned in predetermined, substantially parallel, spaced relation below the bottom surface, and which is further releasably supported by the plurality of legs, and wherein the cavity is sized to receive and store the legs, and the shelf of the portable kitchen when the portable kitchen is not in use.

25. A portable camping kitchen as claimed in claim 20, and wherein a drain aperture and keyway is formed in each of the first and second sink areas, and wherein the portable kitchen further comprises:

a drain fixture having a main body and which defines a key, and which is aligned and received in the respective drain apertures and keyways, and wherein the key, which has been received through the keyway, releasably engages the kitchen surface and simultaneously positions the drain fixture in draining relation relative to the respective sink areas when the drain fixture is rotated.

26. A portable camping kitchen as claimed in claim 20, and wherein the heat resistant surface has a first end which is releasably mounted to one of the plurality of mounting stations, and an opposite second end which is supported by a pair legs.

27. A portable camping kitchen as claimed in claim 20, and further comprising:

a plurality of posts mounted on the top surface of the kitchen surface, and located adjacent to the first and second sink areas; and a supporting surface having a peripheral edge, and wherein a plurality of apertures are formed in a given pattern about the peripheral edge, and wherein the supporting surface can be alternatively disposed in at least partial covering relation over one of the first or second sink areas, and wherein the plurality of posts are received in the respective apertures formed about the peripheral edge of the supporting surface to substantially maintain the supporting surface in at least partial covering relation relative to one of the first or second sink areas; and wherein the supporting surface has a recessed edge which facilitates access to the underlying first or second sink areas when the supporting surface is positioned in partial covering relation relative to the first or second sink area.

28. A portable camping kitchen as claimed in claim 27, and further comprising a second supporting surface which is disposed in at least partial covering relation relative to the remaining sink area, and wherein a substantially continuous and coplanar surface is defined between the first and second ends of the kitchen surface when both sink areas are at least partially covered by the respective supporting surfaces.

29. A portable camping kitchen as claimed in claim 27, and wherein the supporting surface is disposed in a substantially continuous and coplanar orientation relative to the food preparation area which is defined by the kitchen surface when the supporting surface is disposed in at least partial covering relation relative to the first sink area.

30. A portable camping kitchen as claimed in claim 29 and wherein the supporting surface is disposed in a spaced, substantially coplanar orientation relative to the food preparation area when the supporting surface is disposed in at least partial covering relation relative to the second sink area.

31. A portable camping kitchen, comprising:

a kitchen surface having opposite first and second ends, and top and bottom surfaces, and wherein the kitchen surface has a peripheral surface which extends generally downwardly relative to the top surface, and which defines, with the bottom surface a storage cavity, and wherein the top surface further defines a food preparation area which is located adjacent the first end of the kitchen surface and which further has a peripheral edge, and a drainage channel is formed on the top surface and which is oriented along at least one of the peripheral edges of the food preparation area and in fluid draining relation relative thereto, and wherein the top surface further defines a first sink area which is oriented in juxtaposed relation relative to the food preparation area and wherein the first sink area has a drain aperture formed therein, and wherein the drainage channel is coupled in fluid draining relation relative to the first sink area, and wherein the top surface further defines a second sink area which is located adjacent to the second end of the top surface, and wherein the second sink area has a drain aperture formed therein, and wherein a plurality of posts are mounted on the top surface of the kitchen surface and which surround, in part, the respective first and second sink areas, and wherein a plurality of mounting stations are defined about the peripheral surface which extends downwardly relative to the top surface and wherein the mounting stations comprise respective pairs of apertures which extend through the peripheral edge;

a plurality of legs moveably mounted in a location which is adjacent to the bottom surface of the kitchen surface and which support the kitchen surface in spaced relation relative to a surface of the earth, and wherein at least one to the plurality of legs is adjustable as to length;

a shelf positioned below, and in substantially parallel spaced relation relative to the bottom kitchen surface, and wherein the shelf is borne by the plurality of legs;

a faucet assembly releasably mounted on the top kitchen surface and which is operable to deliver a source of water to the respective first and second sink areas;

a drain fixture releasably received in each of the respective drain apertures;

a supporting surface which has a surface area defined by a peripheral edge, and wherein a plurality of apertures are formed in a pattern about the peripheral edge, and wherein the supporting surface is operable to be positioned in at least partial covering relation relative to one of the first or second sink areas, and wherein the posts mounted on the top surface are received in the apertures formed in the peripheral edge to appropriately position and secure the supporting surface in at least partial covering relation relative to the first or second sink areas and wherein the supporting surface defines a recessed edge which facilitates access to the underlying first or second sink areas when the supporting surface is positioned in partial covering relation relative to the first or second sink areas; and a heat resistant surface having a first end which releasably engages one of the mounting stations which are defined by the peripheral surface of the kitchen surface, and an opposite second end, and wherein a pair of legs are mounted on the second end of the heat resistant surface, and which support the heat resistant surface in spaced relation relative to a supporting surface, and wherein the heat resistant surface can be located in a plurality of different substantially horizontal orientations relative to the kitchen surface.

32. A portable camping kitchen as claimed in claim 31, and wherein a plurality of heat resistant surfaces can be releasably mounted to the kitchen surface substantially simultaneously and all simultaneously oriented in substantially horizontal orientations.

33. A portable camping kitchen as claimed in claim 31, and wherein a second supporting surface can be oriented in at least partial covering relation relative to one of the sink areas, and wherein a substantially continuous and coplanar supporting surface is defined between the first and second ends of the kitchen surface.

34. A portable camping kitchen as claimed in claim 31, and further comprising a hanging rack which may be releasably mounted in a plurality of locations relative to the top kitchen surface.

35. A portable camping kitchen as claimed in claim 31, and wherein the supporting surface when disposed in at least partial covering relation relative to one the sink area permits access to sink area located therebelow.

* * * * *

UNITED STATES PATENT AND TRADEMARK OFFICE

CERTIFICATE OF CORRECTION

PATENT NO. : 6,883,881 B2
DATED : April 26, 2005
INVENTOR(S) : Kurt F. Gauss

It is certified that error appears in the above-identified patent and that said Letters Patent is hereby corrected as shown below:

Column 10,
Line 19, replace "sink area 411" with -- sink area 41 --.

Column 11,
Line 33, delete the period "." and insert a semi-colon -- ; -- and include the word -- and --.
Line 34, insert the following text:
-- further comprising a supporting surface which can be releasably mounted on the kitchen surface and disposed in at least a partial covering relation relative to one of the first or second sink areas, and wherein the supporting surface has a recessed edge which facilitates access to the at least one of the first or second sink areas when the supporting surface is disposed in at least partial covering relation relative to at least one of the first or second sink areas. --.

Column 11,
Line 64, delete "drain apertures; and" and replace with -- drain apertures. --.
Line 65, delete "futher comprising a supporting surface which can be releasably mounted on the kitchen surface and disposed in at least a partial covering relation relative to one of the first or second sink areas, and wherein the supporting surface has a recessed edge which facilitates access to the at least one of the first or second sink areas when the supporting surface is disposed in at least partial covering relation relative to at least one of the first or second sink areas.".

Column 13,
Line 33, replace "claim 22," with -- claim 20, --.

UNITED STATES PATENT AND TRADEMARK OFFICE

CERTIFICATE OF CORRECTION

PATENT NO. : 6,883,881 B2
DATED : April 26, 2005
INVENTOR(S) : Kurt F. Gauss

It is certified that error appears in the above-identified patent and that said Letters Patent is hereby corrected as shown below:

Column 16,
Line 27, replace “one the sink” with -- one of the sink --.

Signed and Sealed this

First Day of November, 2005

JON W. DUDAS
*Director of the United States Patent and Trademark Office*